United States Patent [19]

Backstein

[11] Patent Number: 5,042,387

[45] Date of Patent: Aug. 27, 1991

[54] APPARATUS FOR DESTROYING A MOORED MINE

[75] Inventor: Günter Backstein, Meerbusch, Fed. Rep. of Germany

[73] Assignee: Rheinmetall GmbH, Düsseldorf, Fed. Rep. of Germany

[21] Appl. No.: 522,894

[22] Filed: May 14, 1990

[30] Foreign Application Priority Data

May 12, 1989 [DE] Fed. Rep. of Germany ..... 3915577

[51] Int. Cl.[5] ..... B63G 7/02

[52] U.S. Cl. ..... 102/402; 89/1.13

[58] Field of Search ..... 102/402, 406; 89/1.11, 89/1.13

[56] References Cited

U.S. PATENT DOCUMENTS

| | | | |
|---|---|---|---|
| 3,117,518 | 1/1964 | Porter et al. | 102/402 |
| 4,038,901 | 8/1977 | Backstein | 89/1.14 |
| 4,120,246 | 10/1978 | Sabranski et al. | 102/307 |
| 4,369,709 | 1/1983 | Backstein et al. | 102/414 |
| 4,696,234 | 9/1987 | Kaltmann et al. | 89/1.14 |
| 4,970,957 | 11/1990 | Backstein et al. | 89/1.13 |

FOREIGN PATENT DOCUMENTS

| | | | |
|---|---|---|---|
| 3626434 | 2/1988 | Fed. Rep. of Germany | 402/ |

OTHER PUBLICATIONS

W. Flume, "Minenbekämpfung", *Wehrtechnik*, 1983, No. 10, pp. 66–67.

*Primary Examiner*—Charles T. Jordan
*Attorney, Agent, or Firm*—Spencer & Frank

[57] ABSTRACT

An apparatus for destroying a mooring mine, which can be deployed with known underwater drones as well as with area sweeping devices to grip a mine mooring connecting a mine body to a mine seat, is composed of a mine sweeping unit and a ballast unit. Both units, which are releasably connected to each other, include active charges with which, if actuated simultaneously from a remote location, it is possible to disintegrate a mine seat as well as sever a mine body from the mooring joining the two units and destroy the mine body. Preferably, the overall specific weight of the apparatus is equal to that of water, with the ballast unit having a heavier specific weight and the mine sweeping unit having a lighter specific weight, so that the ballast unit and mine sweeping unit automatically move respectfully down and up toward the mine body and mine seat after engaging the mooring and being released from each other.

15 Claims, 1 Drawing Sheet

APPARATUS FOR DESTROYING A MOORED MINE

CROSS-REFERENCE RELATED APPLICATIONS

This application claims the priority of Federal Republic of Germany application Serial No. P 39 15 577.3 filed May 12th, 1989, which is incorporated herein by reference.

BACKGROUND OF THE INVENTION

The present invention relates to an apparatus for destroying an anchor chain or moored mine, which includes a mine sweeping unit and a ballast unit releasably connected therewith as well as a recess or receptacle for receiving an anchor chain or mine mooring and a clamping device for gripping the mine mooring.

Such mine sweeping devices and methods connected with it for combatting mooring mines are also disclosed in U.S. Pat. No. 4,120,246 and in the article entitled, "Minenbekämpfung" by W. Flume, published in the periodical "Wehrtechnik", 1983, No. 10, pages 66 and 67. These devices separate the moored mine from its anchorage in a body of water by severing the mine mooring which establishes a connection between the mine body and the mine seat, allowing the mine body to float to the surface of the water. Customarily, once the mine body has floated to the surface, it is destroyed by firing at it.

This method has the drawbacks that it is generally not employable at night, and that the mine is not destroyed directly by the sweeping device, but only after it appears on the surface.

Such a device for combatting moored mines is disclosed, for example, in U.S. Pat. No. 4,696,234, the disclosure of which is incorporated herein by reference. In this device, a gripper grips the mine mooring and a buoyancy-producing means causes the device to move upward on the chain to contact and explode the main body.

Moreover, with all of these prior art devices, the mine seat at the bottom of the water, that is the anchorage for the moored mine, remains intact, and there arises the problem that, during later renewed mine sweeping or hunting operations, the mine seat is detected as a mine-like object which therefore must be newly identified, although this is in fact an unnecessary procedure.

SUMMARY OF THE INVENTION

In view of these drawbacks, it is therefore an object of the invention to provide a novel apparatus for combatting anchor chain or moored mines, with which, essentially in one process step, a mine body and its mine seat can be destroyed regardless of the time of day. This is accomplished by an apparatus according to the invention, which includes a mine sweeping unit and a ballast unit releasably connected therewith, as well as a recess or receptacle for receiving mooring, and a clamping device for gripping the mooring, wherein both the mine sweeping unit and the ballast unit are provided with at least one explosive charge for respectively destroying the mine body and the anchor mooring and mine seat (hereinafter referred to as "mine seat"), and the ballast unit can be guided along the mooring downward to the mine seat.

The great advantage of this apparatus is that it is composed of two units which are releasably connected together and both contain active charges, with one unit, the mine sweeping unit, serving to destroy the actual mine body, and the other unit, the ballast unit, serving to disintegrate the mine seat.

As a further advantageous feature of the invention the mine sweeping unit and the ballast unit have specific weights respectively less than and greater than that of water so that, once the mooring has been gripped and secured, the lower specific weight mine sweeping unit floats upward along the mooring to the mine body and the higher specific weight ballast unit drops along the mooring to the mine seat. Then, upon ignition of the respective explosive charges, both the mine body and the mine seat are destroyed.

BRIEF DESCRIPTION OF THE DRAWINGS

These and other features and advantages of the invention may be more completely understood from the following detailed description of the preferred embodiments of the invention with reference to the accompanying drawings in which.

DETAILED DESCRIPTION OF THE PREFERRED EMBODIMENT

Figures 1, 2, 3, 4:
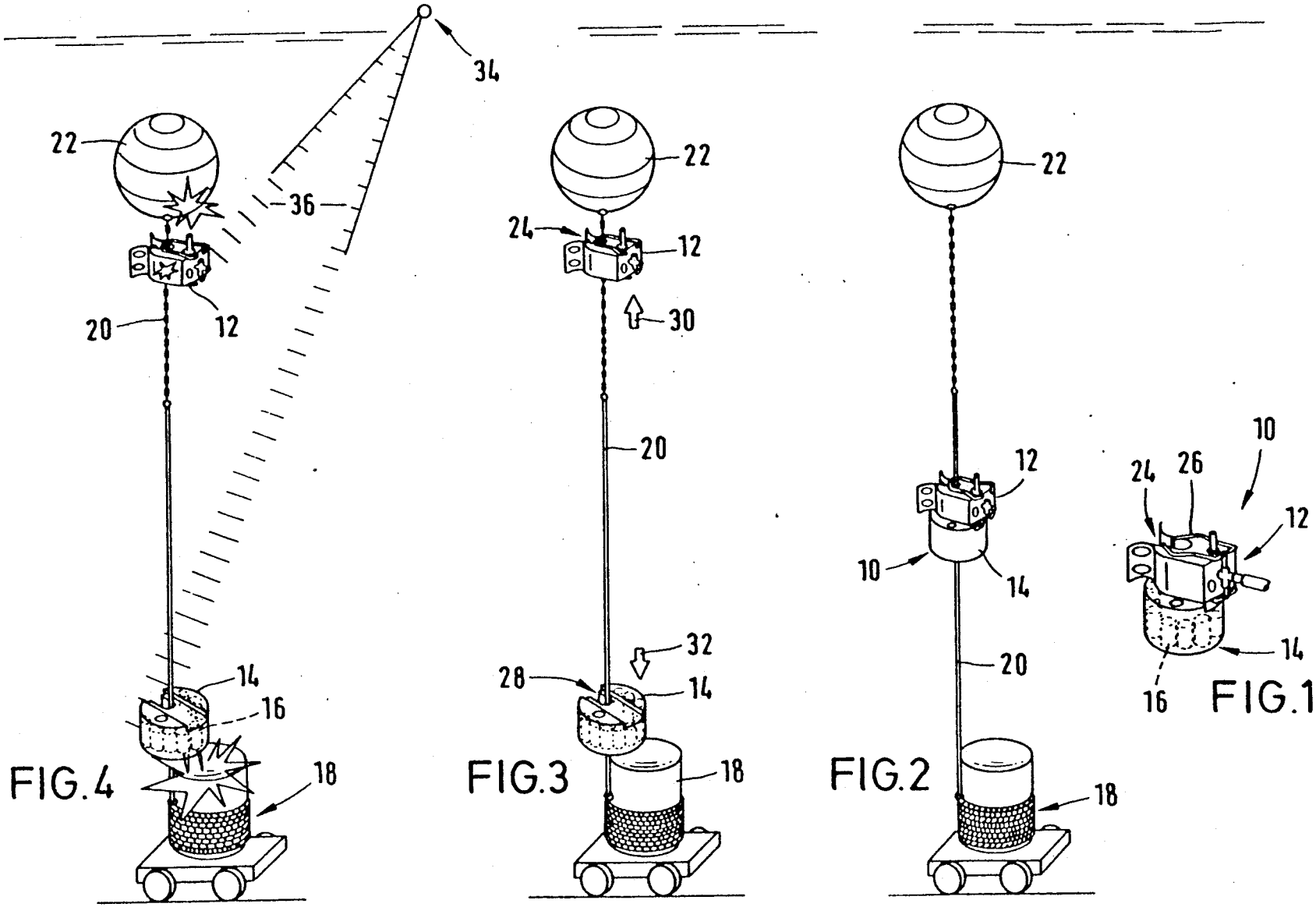
FIG. 1 is a perspective view of one embodiment of the apparatus for combatting mooring mines according to the invention.
FIG. 2 shows the apparatus according to FIG. 1, gripping the mine mooring of a moored mine in a body of water.
FIG. 3 shows the apparatus according to FIG. 1, gripping the mine mooring after its mine sweeping unit has been separated from its ballast unit.
FIG. 4 shows the apparatus of the invention in the positions shown in FIG. 3, upon remote firing thereof for the destruction of a mine body and its associated mine seat.

FIG. 1 shows an apparatus 10 according to the invention.

Referring to FIG. 1, the apparatus 10 for combatting anchor chain or moored mines according to the invention includes a mine sweeping unit 12 and a ballast unit 14, which are releasably connected together. Preferably, the mine sweeping unit 12 has a specific weight lighter than that of water, and the ballast unit 14 has a specific weight greater than that of water. The specific weights of both units 12 and 14 are preferably selected so that the apparatus 10 itself, that is, the mine sweeping unit 12 and ballast unit 14 together, has a combined specific weight which is substantially the same as that of water so that the apparatus is neutral as to an upward flow in the water, that is, neutrally buoyant.

The ballast unit 14 includes at least one downwardly directed charge, and preferably several downwardly directed, shaped charges or projectiles which form the illustrated charges 16. As shown in FIG. 1, a receptacle or recess 24 for receiving the mine mooring 20 of a moored mine, is provided in the mine sweeping unit 12. The ballast unit 14 has a corresponding receptacle or recess 28 (see FIG. 3) for receiving the mooring 20.

In addition, conventional clamping devices 26 are respectively provided in the mine sweeping unit 12 and the ballast unit 14. A suitable clamping device is described, for example, in the above mentioned U.S. Pat. No. 4,696,234 and in U.S. Pat. No. 4,369,709.

Once the apparatus 10 is brought close to a mooring 20 by a conventional underwater drone or part of an area sweeping device, the clamping devices 26 are employed to position the apparatus 10 with the mooring in the receptacles or recesses 24 and 28. The clamping. devices 26 then surround the mooring 20 to fix the apparatus there. This stage in the use of the apparatus 10 is shown in FIG. 2.

As shown in FIG. 3, a connection between the two units 12 and 14 of the apparatus is released. Due to the differences in specific weight of the two units, the lighter specific weight mine sweeping unit rises along the mooring 20 toward the mine body 22, as indicated by an arrow 30. The heavier specific weight ballast unit 14 drops along the mooring 20 toward the mine seat 18, as indicated by an arrow 32.

As shown in FIG. 4, after a given period of time measured from the time of separation of the mine sweeping units 12 and the ballast unit 14, conventional safety devices included in the units 12 and 14 are released so that the units 12 and 14 become live.

The mine sweeping unit 12 preferably includes at least two active charges, one charge serving to sever the mooring 20 and the further charge(s) serving to destroy the mine body 22. The at least one and preferably several active charges 16 are oriented downwardly, i.e. toward the mine seat 18, for disintegrating the mine seat 18.

In order to initialize the active charges of mine sweeping unit 12 and ballast unit 14, a remote control unit is preferably provided. In the embodiment illustrated in the drawings, remote actuation is effected, for example, by a sonar source 34 disposed on board a ship. A sonar beam 36 put out by this sonar source 34 serves to simultaneously actuate the active charges of the mine sweeping unit 12 and the active charges 16 of the ballast unit 14.

It will be understood that the above description of the present invention is susceptible to various modifications, changes and adaptations, and the same are intended to be comprehended within the meaning and range of equivalents of the appended claims.

What is claimed is:

1. An apparatus for destroying a moored mine in a body of water, comprising: a mine sweeping unit having means for destroying a mine body attached to an upper end of a mine mooring, a ballast unit reliably connected to said mine sweeping unit, means for attaching the apparatus to the mooring so as to be movable along the mooring, and guiding means for guiding said ballast unit along the mooring, said ballast unit including at least one first explosive active charge for destroying a mine seat attached to a lower end of the mooring.

2. An apparatus as in claim 1, wherein said mine sweeping unit includes means for moving said mine sweeping unit upward through the body of water along the mooring to the mine body, said means for destroying including at least one second explosive active charge.

3. An apparatus as in claim 2, wherein said means for moving said mine sweeping unit upward comprises means causing the specific weight of said mine sweeping unit to be lighter than that of the water, the specific weight of said ballast unit being heavier than that of the water, so that, with the apparatus attached to the mooring and said ballast unit released from said mine sweeping unit, said mine sweeping unit floats upward along the mooring toward a mine body attached to an upper end of the mooring and said ballast unit sinks downward along the mooring guided by said guiding means to the mine seat.

4. An apparatus as in claim 1, wherein the apparatus has an overall specific weight selected so that the apparatus is essentially neutral with respect to an upward flow in the water.

5. An apparatus as in claim 4, wherein said means for attaching the apparatus to a mine mooring includes first attaching means for attaching said mine sweeping unit to the mooring so as to be movable therealong, and wherein the specific weight of said mine sweeping unit is lighter than that of the water and the specific weight of said ballast unit is heavier than that of the water, so that, with the apparatus attached to the mooring and said ballast unit released from said mine sweeping unit, said mine sweeping unit floats upward along the mooring toward a mine body attached to an upper end of the mooring and said ballast unit sinks downward along the mooring guided by said guiding means to the mine seat.

6. An apparatus as in claim 5, wherein said mine guiding means comprises a recess of said ballast unit, and a clamping device on said ballast unit for clamping the mooring in said recess.

7. An apparatus as in claim 6, wherein said means for destroying includes at least one second explosive active charge.

8. An apparatus as in claim 7, wherein said mine sweeping unit and said ballast unit include:

safety devices for preventing premature actuation of the respective charges of said mine sweeping unit and said ballast unit, fuzes for actuating said respective charges of said mine sweeping unit and said ballast unit, and receiving devices having means for receiving and responding to a remotely transmitted sonar signal to ignite said fuzes.

9. An apparats for destroying a mooring mine in a body of water, comprising: a mine sweeping unit having first means for attaching said mine sweeping unit to a mine mooring so as to be movable along the mooring, and a ballast unit releasably connected to said mine sweeping unit and having a second means for attaching said ballast unit to the mooring so as to be movable along the mooring, said ballast unit including at least one first explosive active charge for destroying a mine seat attached to a lower end of the mooring, said mine sweeping unit including means for moving said mine sweeping unit upward through the body of water along the mooring to a mine body attached to an upper end of the mooring, and at least one second explosive active charge for destroying the mine body.

10. An apparatus as in claim 9, wherein said means for moving said mine sweeping unit upward comprises means causing the specific weight of said mine sweeping unit to be lighter than that of the water, the specific weight of said ballast unit being heavier than that of the water, so that, with the apparatus attached to the mooring and said ballast unit released from said mine sweeping unit, said mine sweeping unit floats upward along the mooring toward a mine body attached to an upper end of the mooring and said ballast unit sinks downward along the mooring to the mine seat.

11. An apparatus as in claim 9. wherein the apparatus has an overall specific weight selected so that the apparatus is essentially neutrally buoyant with respect to the water.

12. An apparatus as in claim 11, wherein said means for moving said mine sweeping unit upward comprises means causing the specific weight of said mine sweeping unit to be lighter than that of the water, the specific weight of said ballast unit being heavier than that of the water, so that, with the apparatus attached to the mooring and said ballast unit released from said mine sweeping unit, said mine sweeping unit floats upward along the mooring toward a mine body attached to an upper end of the mooring and said ballast unit sinks downward along the mooring to the mine seat.

13. An apparatus as in claim 12, wherein said first attaching means includes a recess of said ballast unit, and a clamping device on said ballast unit for clamping the mooring in said recess.

14. An apparatus as in claim 13, wherein said mine sweeping unit and said ballast unit include:

means for preventing premature actuation of the respective charges of said mine sweeping unit and said ballast unit, fuzes for actuating said respective charges of said mine sweeping unit and said ballast unit, and means for receiving and responding to a remotely transmitted signal to ignite said fuzes.

15. An apparatus as in claim 14, wherein said safety devices comprise means for preventing actuation of said respective charges for a predetermined period of time following a separation from each other of said mine sweeping unit and said ballast unit.

* * * * *